United States Patent [19]

von Stutterheim

[11] 4,149,942

[45] Apr. 17, 1979

[54] PROCESS FOR DISSOLVING METALS IN FUSED SALT BATHS

[76] Inventor: Friedrich von Stutterheim, Adenaueralle 7, 637 Oberursel, Fed. Rep. of Germany

[21] Appl. No.: 832,199

[22] Filed: Sep. 12, 1977

Related U.S. Application Data

[63] Continuation of Ser. No. 565,106, Apr. 4, 1975.

[30] Foreign Application Priority Data

Apr. 10, 1974 [DE] Fed. Rep. of Germany ..... 2417424

[51] Int. Cl.[2] ..... C25B 1/00; C01C 3/11; C01C 3/16

[52] U.S. Cl. ..... 204/63; 204/39; 423/365; 423/366; 423/371; 423/378; 423/379

[58] Field of Search ..... 204/39, 63; 423/365, 423/366, 371, 378, 379, DIG. 12

[56] References Cited

U.S. PATENT DOCUMENTS

| | | | |
|---|---|---|---|
| 2,093,406 | 9/1937 | Atkinson | 204/39 |
| 2,929,766 | 3/1960 | Withers et al. | 204/32 |
| 3,309,292 | 3/1967 | Andrews et al. | 204/39 |
| 3,547,789 | 12/1970 | Andrews et al. | 204/39 |

OTHER PUBLICATIONS

Smith et al., Plating, Jul. 1969, pp. 805–808.

*Primary Examiner*—F. C. Edmundson
*Attorney, Agent, or Firm*—Richards, Harris & Medlock

[57] ABSTRACT

A process for dissolving metals, alloys or metallic compound materials in metal cyanamide and/or thiocyanate and/or cayanide and/or halide melts containing optionally metal carbonate and/or cyanide, characterized in that substances are added to the melt which form or liberate CN, and/or CNO and/or SCN radicals in the melt under the reaction conditions.

8 Claims, No Drawings

PROCESS FOR DISSOLVING METALS IN FUSED SALT BATHS

This is a continuation application of Ser. No. 565,106, filed Apr. 4, 1975.

The invention relates to a method for dissolving metals in fused salt baths, i.e., melts of inorganic salts or salt mixtures. Many metals can be dissolved in aqueous agents by means of acids or bases. Furthermore, oxidizing agents have to be added depending on the metal's place in the electrochemical series. Thus, aqua regia, a mixture of hydrochloric and nitric acid, is a well known aqueous solvent. The dissolution can also be improved by the oxidizing influence of a galvanic current.

It is extremely difficult to dissolve those metals which are protected against corrosion by formation of oxide or hydrate barriers. Furthermore, aqueous solutions of metals are not suitable for a number of applications. In electrolytic procedures only rather low current densities can be achieved. In addition, the electrolytic plating of refractory metals is affected or hindered by interaction between the oxygen in the solution and the metal surface. Moreover, many chemical reactions are not practicable in aqueous solutions because of the amphoteric character of a number of metals, Finally, numerous metals cannot be separated from each other in aqueous systems for different chemical reasons. Above this under standard conditions the temperature is limited to approximately 100° C. A temperature increase above boiling point requires the use of excess pressure in autoclaves. This increases the costs considerably.

Principally, it is already known that many metals are soluble in molten salt baths at temperatures higher than 100° C. U.S. Pat. Nos. 2,093,406, 2,929,766, 3,309,292 and 3,547,789 show several procedures by which noble metals may be dissolved in molten alkali metal cyanides. Either the metals have to be dipped into the melt where they are mechanically agitated (U.S. Pat. No. 2,093,406), or a galvanic current has to be applied between two electrodes of the same metal. During this process the current's polarity is reversed (U.S. Pat. Nos. 2,093,406, 2,292,766 and 3,309,292). U.S. Pat. No. 3,547,789 suggests a process in which oxygen is fed into the melt to offer an oxidizing agent for the dissolution of the metal.

All these procedures share the disadvantage that one can achieve only low concentrations of the metals to be dissolved. They usually do not exceed a value of about 1.5% by weight with the first-mentioned processes. This is presumably due to the fact that no chemical oxidizing agents are offered, and complex ions of subnormal valency which are possibly formed show low stability. According to the process of U.S. Pat. No. 3,547,789, the cyanate and carbonate, formed by oxidation, apparently limit the solubility of the metal as all the metal exceeding the limit of about 1 to 1.5% by weight is precipitated from the melt, possibly in form of oxygen containing compounds. The concentrations of precious metals in the melt, achievable without chemical oxidizing agents, are even lower.

All known treatments are not practicable for dissolution of highly passivated, non-noble metals. In U.S. Pat. No. 2,093,406 it is stressed explicitly that noble metals can be stripped from non-noble metals without corrosion affecting the latter.

Higher concentrations of noble metals in the melt would be of great advantage for many applications. The current densities at electro-plating processes could be increased; therefore the plating equipment could be made more compact. Oxygen-free salt solutions would allow the electro-plating of metals which otherwise develop hydrated or not hydrated oxide coatings. Many chemical reactions would be practicable in these molten salt baths which are impossible in aqueous systems, e.g., the production of certain complex metal cyanides, cyanates and thiocyanates.

For many non-noble and noble metals there are no or only unsuitable electrolytes for plating processes, e.g., for titanium, niobium, tantalum, as well as molybdenum, tungsten, ruthenium, and osmium.

It is the object of the invention to find a method for dissolving metals in molten salt baths by which non-noble as well as noble metals are soluble. In contrast to treatments known until now, first of all higher metal concentrations shall be achieved. If necessary, it should be possible to work in an oxygen-free system.

To solve this problem, a process for the dissolution of metals, alloys and metallic compound materials is proposed in which the solvent is a metal cyanamide and/or thiocyanate and/or cyanide and/or halide melt which optionally contains metal carbonate and/or cyanate. The process for dissolving the metals is characterized by adding substances to the melt which form or liberate under the reaction conditions CN, CNO, or SCN radicals in the melt. The selection of the components of the melt can be regarded e.g. under the point of view of reaching a low melting point of the system. Preferably melts of alkali and alkaline earth metal salts are used; melts of a high content of alkali metal cyanides, e.g., potassium- or sodium cyanide, or thiocyanates have advantages in respect to oxygen-free systems. It is at will to leave the system free of oxygen to prevent a passivation of non-noble metals, or to achieve a passivation of specific metals by adding alkali metal cyanates and/or carbonates in order to segregate passivated and not passivated metals.

The process of dissolution can optionally be assisted by applying a galvanic current where the metal to be dissolved is anodically contacted and dipped into the melt. According to the invention CN, CNO, or SCN radicals formed in situ are the oxydizing agent.

The invention can be practiced in different ways: (a) It is possible to add fluid, gaseous or solid compounds to the melt which form CN or CNO radicals by their decomposition under the temperature conditions of the melt and possibly also under catalytic conditions, given by the metals to be dissolved. Those substances are amongst others hydrogen cyanide, cyanic acid, gaseous cyanogen, dicyanimide, cyanamide, cyanhalides, as well as e.g. cyanuric acid, cyanuric halide, melamine and higher polymers and derivatives with or without triazin configuration or polymeric hydrogen cyanide. Nitriles, oxalic amide and ethylenediamide may also be used.

(b) Finally, chemical compounds out of nitrogen, carbon and perhaps also sulfur can be added to the melt out of which CN—,CNO— or SCN-radicals are formed in situ by synthesis under the catalytic influence of the metals, already dissolved or to be dissolved, and the temperature conditions of the melt. This way of carrying out is recommended if the melt has already reached a certain content of dissolved metal, as it is practicable according to (a). As substances for these reactions, methane, carbon monoxide and ammonia may be mentioned.

According to the invention, all platinum metals (ruthenium, rhodium, palladium, iridium, osmium and platinum) as well as gold and silver can be dissolved. Furthermore, non-noble metals are soluble, cadmium, copper, nickel and tin being of particular technical interest. Even those metals can be dissolved which are highly passive due to oxide barriers; interesting examples are chromium, moybdenum, tungsten, rhenium, hafnium, zirkonium, as well as titanium, tantalum and niobium. The dissolution becomes possible when the passivating oxide barrier is taken off before dipping the metal into the melt. Oxygen-free systems are needed for the dissolution of passive metals. They also prevent the metals from segregation out of the melt.

The metals are dissolved in the form of cyanides or cyanates, but afterwards their ions are kept in the melt by the ions of the matrix melt. Even those metals are soluble whose cyanides and cyanates are unknown or instable in aqueous systems. This is valid especially for amphoteric metals which hydrolize in aqueous solutions even at low pH values. Some cyanides of the noble metals are instable, too, or difficult to produce in aqueous systems. They can however be produced and kept in the melt under the conditions of the invention.

Tests have to decide about the optimal conditions for dissolving a specific metal. The temperature range of the matrix melt is of high importance, its lowest limit may be fixed by a selection of salts with low melting point and their appropriate mixing proportions. Furthermore, one has to take care that oxygen is excluded if highly passivated metals shall be dissolved, as was already mentioned before.

The metal solutions in molten salt baths preparable by this invention are very useful for many applications. They can be used for the production of highly pure metal coatings, e.g., by electrolytical plating processes where high metal contents are advantageous. The possibility for supplying melts free of oxygen allows to coat even metals with high affinity to oxygen without affecting the adhesion of the coatings by metal oxide interlayers.

Furthermore, noble metals can be recovered from scrap by applying this treatment in a very simple manner. The possibility should also be noted that highly pure complex metal cyanides can be produced by the application of this invention.

To illustrate the possibilities of the invention, the following examples are given. All percentages are given by weight.

EXAMPLE 1

Hundred grams of a mixture of 30% potassium cyanide and 70% sodium cyanide were put into a passivated titanium crucible and molten at a temperature of about 540° C. A platinum bar of 15 grams was put into the melt, and 1.5 grams melamine were added. While melamine was decomposed in the cyanide melt, 6.5 grams of the platinum were dissolved within a few minutes. The test was stopped before reaching a maximum of solubility.

EXAMPLE 2

Test 1 was repeated, but instead of melamine, cyanogen gas was fed into the melt. 4.2 grams of platinum were dissolved within a short period without reaching a limit of solubility.

EXAMPLE 3

A melt of 450 grams potassium cyanide and 550 grams potassium thiocyanate was kept in a carbon crucible under an argon atmosphere. A plate of molybdenum was put into the melt, and melon—a trimer of melamine—was added. Melon was decomposed under gas formation and a weight decrease of the metal plate of 2.8 grams was found. The corrosion attacked the molybdenum over the whole immersed part of the plate. By adding more melon the molybdenum concentration of the melt could be increased to 1.2%.

Subsequently, the molybdenum plate as anode and a nickel plate as cathode were dipped into the melt and linked with an external source of current. A well adhering molybdenum coating was formed on the nickel plate.

EXAMPLE 4

Under an inert gas atmosphere titanium was added to a melt of potassium cyanide in order to gather the oxygen from the melt. After removing the titanium a carefully cleaned tantalum plate was put into the melt which was anodically contacted against the graphite crucible. Subsequently cyanogen gas was led into the melt. A weight loss of 4.1 grams tantalum was measured after about 1.5 hours.

The test with cyanogen was stopped and cyanamide was used instead. A further weight loss of 3.8 grams tantalum was measured. This corresponds to a tantalum concentration of about 1.3%. No tantalum sludge was found.

EXAMPLE 5

A melt of potassium was gettered by using titanium under inert gas conditions. Then, granulated silver was added to the melt and cyanamide fed into the melt. After a very short time a silver content of 2.3% was analyzed in the melt. Applying the silver containing molten salt electrolyte 200 microns thick coatings could be deposited on a plate of molybdenum, by using a direct current source and a silver plate anodically contacted against the molybdenum plate.

EXAMPLE 6

A melt of potassium cyanide and thiocyanate in equal proportions was kept in a graphite crucible. Under inert gas a rhodium powder, in a passivated titanium crucible, was dipped into the melt. By adding cyanamide, 2.8 grams of rhodium were dissolved. The dissolving process was stopped without achieving the highest concentration. Rhodium coatings from this melt were deposited electrolytically on a tantalum plate; using a rhodium wire as anode; the coating showed good adhesion.

EXAMPLE 7

A melt of potassium thiocyanate was kept in a carbon crucible under inert gas at 200° C. A tin bar was dipped into the melt and hydrogen cyanide was added. The dissolution process of the tin took place very fast. The tin concentration of the melt reached more than 8% and was used for the electroplating of a nickel plate.

EXAMPLE 8

A palladium coated titanium plate was dipped into a melt of potassium thiocyanate and potassium cyanate in equal weight ratios, and cyanogen gas was fed into the melt. The palladium coating was stripped within a few minutes without a remarkable corrosion of titanium. The latter changed into a brown color by forming an oxide coating.

EXAMPLE 9

A melt of 30% potassium cyanide and 70% sodium cyanide was kept in a carbon crucible under inert gas. At a temperature of about 545° C. a platinum bar was hung into the melt, and a mixture of 98 vol % argon, 1.4 vol % carbon monoxide, 0.6 vol % ammonia was fed into the melt through a graphite tube. After several hours the white color of the melt in solid state had changed into a strong yellow, a sign for dissolution of platinum. The melt was used for electrodeposition of a platinum coating on a nickel plate.

EXAMPLE 10

The experiment of example 9 was repeated, but instead of the mixture of argon, carbon monoxide and ammonia, a mixture of 99.5 vol % argon and 0.5 vol % dry hydrogen chloride gas was fed into the melt, containing a piece of ruthenium. The test was stopped after a few hours, and the melt was used for electroplating of a niobium plate with a ruthenium coating. The ruthenium concentration of the melt was estimated about 4% by weight by measuring the weight of the undissolved ruthenium.

What is claimed is:

1. A process for dissolving metallic materials selected from the group consisting of platinum metals, gold, silver, cadmium, copper, nickel, tin, chromium, molybdenum, tungsten, rhenium, hafnium, zirconium, titanium, tantalum, niobium, and alloys thereof in a salt melt, said melt being selected from the group consisting of alkali metal cyanamide, alkaline earth metal cyanamide, alkali metal thiocyanate, alkaline earth metal thiocyanate, alkali metal cyanide, alkaline earth cyanide, alkali metal halide, alkaline earth halide, and combinations thereof which process comprises contacting the metal to be dissolved with said melt and adding to said melt additives which form oxidizing agents, said additives being selected from the group consisting of compounds, which under the conditions of the melt, will decompose in the presence of said metal to be dissolved to form free CN, CNO or SCN radicals and reactants which will react under the conditions of the melt in the presence of said metal to be dissolved to form free CN, CNO or SCN radicals, the free radical oxidizing agents so formed being present in said melt while the metal to be dissolved is in contact with said melt.

2. The process according to claim 1 wherein said melt further includes a compound selected from the group consisting of metal carbonate, metal cyanate and mixtures thereof.

3. The process of claim 1, characterized in that the process of dissolving said metallic materials is promoted by contacting the metal anodically while dipping into said melt.

4. The process according to claim 1, wherein said compound which decomposes in the salt to form said free radicals is selected from the group consisting of hydrogen cyanide, cyanic acid, cyanogen, diacyanimide, cyanhalide, their derivatives and polymers with or without triazine configurations.

5. The process of claim 1 wherein said reactants which react to form said free radicals comprise carbon monoxide and ammonia.

6. The process of claim 1 wherein said mixture of reactants comprises methane and ammonia.

7. The process of claim 1 wherein said process is performed in the absence of oxygen.

8. The solution produced by the process of claim 1.

* * * * *